US005343728A

United States Patent [19]

Chubb et al.

[11] Patent Number: 5,343,728

[45] Date of Patent: Sep. 6, 1994

[54] HEAVY DUTY SHEET BENDING BRAKE

[75] Inventors: Arthur B. Chubb, Romulus; James E. Suyak, Lincoln Park, both of Mich.

[73] Assignee: Tapco Products Company, Inc., Detroit, Mich.

[21] Appl. No.: 987,249

[22] Filed: Dec. 7, 1992

Related U.S. Application Data

[63] Continuation of Ser. No. 798,207, Nov. 26, 1991, abandoned.

[51] Int. Cl.[5] ..... B21D 5/04

[52] U.S. Cl. ..... 72/319; 72/455; 248/676

[58] Field of Search ..... 72/319, 323, 149, 159, 72/217, 455; 248/676, 677, 678, 165, 910; 269/901, 139

[56] References Cited

U.S. PATENT DOCUMENTS

| | | | |
|---|---|---|---|
| 131,239 | 9/1872 | Adler . | |
| 934,701 | 9/1909 | Swanson | 72/455 |
| 2,181,566 | 11/1939 | Jensen | 72/319 |
| 2,343,441 | 3/1944 | Babcock | 72/319 |
| 2,434,028 | 1/1948 | Wieland . | |
| 3,481,174 | 12/1969 | Barnack | 72/319 |
| 3,482,427 | 12/1969 | Barnack | 72/319 |
| 4,223,881 | 9/1980 | Hickman | 269/901 |
| 4,372,142 | 2/1983 | Rhoades | 72/319 |
| 4,494,397 | 1/1985 | Rhoades . | |
| 4,557,132 | 12/1985 | Break | 72/319 |
| 4,713,957 | 12/1987 | Eder . | |

FOREIGN PATENT DOCUMENTS

| | | | |
|---|---|---|---|
| 1394222 | 2/1965 | France | 248/676 |
| 403677 | 6/1966 | Switzerland | 248/165 |
| 2206069 | 12/1988 | United Kingdom | 72/149 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprising a first longitudinally extending member having a clamping surface, a clamping member having a member movable toward and away from the clamping surface for holding a workpiece in position for bending and a second member extending longitudinally with respect to said first member. Each of the first and second members have substantially the entire length of the longitudinal edges thereof formed with longitudinally spaced intermeshing integral projections, the projections on the second member having a plurality of aligned openings and the projections on the first member having a plurality of aligned openings comprising slots extending axially with respect to the longitudinal axis of said member. A hinge pin extends through the openings of the second member and the slots of the first member. The second member has a workpiece contacting portion spaced from the projections. The slots have a configuration such that as the second member is moved relative to said first member to bend a workpiece, the hinge pin is guided along said slots such that the contacting portion of said second member remains substantially in the same position relative to the workpiece. A handle member for manipulating the anvil member is constructed to minimize the stresses thereon. The clamping member is constructed to maximize the strength thereof. A stabilizing assembly is associated with the legs on which the clamping brake is mounted.

7 Claims, 3 Drawing Sheets 10
11
12
13
14
15
16
17
18
19
19a
20
21
22
23
24
25
26
27
28
29
30
31
32
33
34
35
36
37
41
42
49
50
51
52
53
56
58
60
63
65
66
H

HEAVY DUTY SHEET BENDING BRAKE

This is a continuation of copending application(s) Ser. No. 07/798,207 filed on Nov. 26, 1991, now abandoned.

This invention relates to sheet bending brakes.

BACKGROUND AND SUMMARY OF THE INVENTION

In recent years, various structures have been provided to form a portable sheet bending brake for bending metal or plastic sheets such as are used in siding on homes and buildings. Typical patents comprise U.S. Pat. Nos. 3,161,223, 3,481,173, 3,482,427, 3,559,444, 3,817,075, 3,872,755 and 4,321,817.

Such brakes comprise a fixed member on which the sheet is clamped and a movable bending member for bending the sheet. A major problem with respect to such sheet bending brakes is the tendency of the bending member to move relative to the portion of the sheet being bent and thereby mar the surface of the sheet.

In U.S. Pat. No. 3,161,223, the tendency to mar the surface of the sheet material was minimized by having the intermeshing integral projection between the fixed member and bending member which extend longitudinally and define the hinge that connects the bending member with the fixed member having the clamping surface, positioned so that all portions of the projections do not extend above the plane of the surface of the members when the surfaces are substantially aligned.

U.S. Pat. Nos. 3,481,174 and 3,482,427 were directed to an arrangement which included a floatable compensator on the bending member which engages the sheet material and as the bending member is swung to bend the sheet pivots so that the contact with the sheet material is maintained.

Accordingly among the objectives of the present invention and to provide a sheet metal bending brake which is relatively light in weight, portable and less costly.

In accordance with the invention, each of the fixed and movable bending members have substantially the entire length of the longitudinal edges thereof formed with longitudinally spaced intermeshing integral projections. The projections on the bending member having a plurality of aligned openings and the projections on the fixed member have a plurality of aligned openings comprising slots extending axially with respect to the longitudinal axis of said member. A hinge pin extends through the openings of said bending member and the slots of the fixed member. The slots have a configuration such that as the bending member is moved relative to the fixed member to bend a workpiece, the hinge pin is guided along said slots such that the contacting portion of the bending member remains substantially in the same position relative to the workpiece. In accordance with the invention, a handle member for manipulating the anvil member is constructed to minimize the stresses thereon. The clamping member is constructed to maximize the strength thereof. A stabilizing assembly is associated with the legs on which the clamping brake is mounted.

DESCRIPTION

Figure 1:
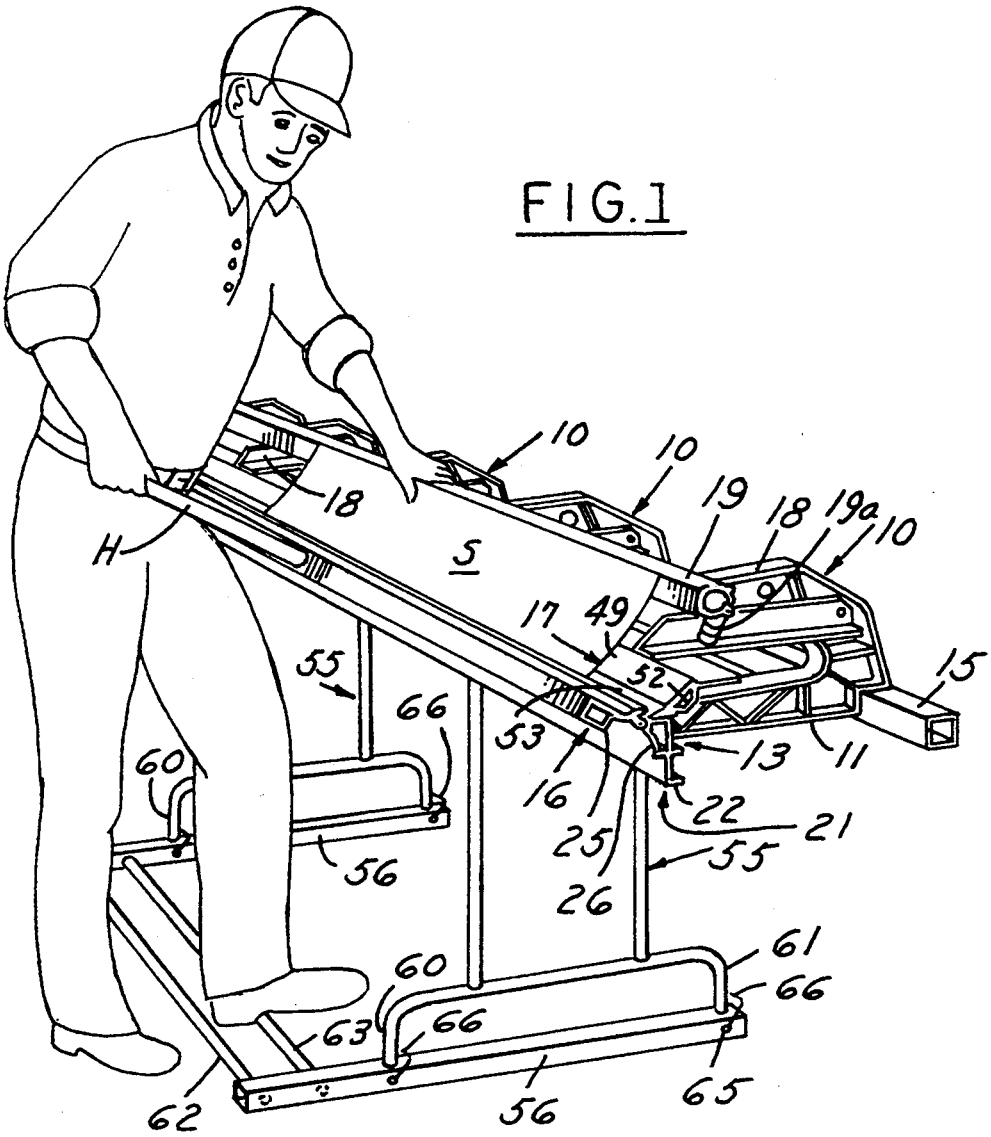
FIG. 1 is a perspective view of a sheet bending brake embodying the invention.
Figure 3:
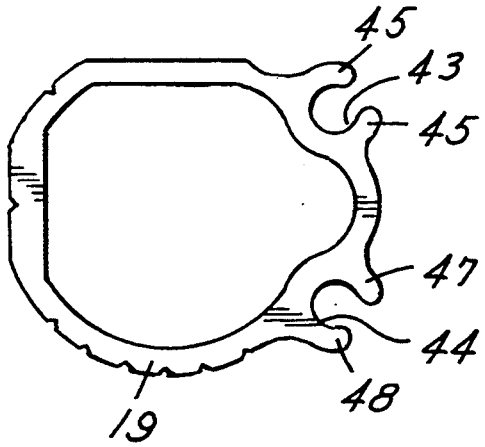
FIG. 3 is a fragmentary vertical section view of a handle member utilized in the sheet bending brake.

Referring to FIGS. 1-4, the sheet bending brake embodying the invention comprises longitudinally spaced C-shaped frame members 10. Each frame member includes a lower arm 11 and an upper arm 12 which overlies the lower arm 11 in spaced relation thereto. Legs may be provided as needed to support the brake above the floor or working area.

A first fixed member 13 is fixed on the ends of the free lower arms 11 and defines a clamping surface 14. A longitudinally spaced base rail 15 is fixed to the rear end of the lower arms 11. A second bending member 16 is hinged to the first member 13, as presently described, to provide a means for bending the sheet material.

Clamping anvil member 17 extends longitudinally in overlying relationship to the clamping surface 14 of the first member 13. Means are provided for moving the anvil member toward and away from the clamping surface to clamp a workpiece on the clamping surface. The means for clamping the workpiece may comprise any of the structures set forth in the aforementioned United States patents, incorporated herein by reference, but as herein shown comprise channel shaped pivot bars 18 pivoted on each frame member 10 with the clamping member 17 fixed thereto and a tubular handle member 19 pivoted to the upper arm 12 of each C-frame member 10 and to the pivot bars 18 by a plurality of extensible links **19*a* pivoted at the upper edge to the handle member 19 and at the lower end to the pivot bars 18. The extensible links 19*a*** may be of the type shown in U.S. Pat. No. 4,766,757, incorporated herein by reference.

In accordance with the invention, the first member 13 having the clamping surface 14 is formed as an aluminum extrusion and includes an upper tubular portion 20 and a lower portion 21 including spaced flanges 22 engaging the free ends of lower arms 11. A plurality of longitudinally spaced projections 23 are provided at the juncture of the portion 20 which defines the clamping surface 14. Each projection 23 has a slot 24 formed therein and the slots 24 of the various projections 23 are in longitudinal alignment. Each slot 24 has its lower ends spaced from the clamping surface A and extends outwardly and upwardly so that its upper end is generally near the plane of the clamping surface. Each slot 24 is preferably arcuate and has a center spaced from the clamping surface and preferably extends for substantially 90°.

The bending member 16 is also in the form of an extrusion including a tubular portion 25 and a longitudinally extending leg 26 with a plurality of longitudinally spaced projections 27 having openings 28 therein. The projections 27 of the bending member 16 mesh with the projections 23 of the fixed member 13 and a pin 29 extends through the openings 28 and slots 24 to hinge the bending member 16 to the fixed member 13. The bending member 16 further includes a portion 30 that extends upwardly and outwardly when the bending member 16 is in position for bending and has a contacting portion defined by a longitudinally extending plastic strip 31 positioned in a recess 32. The recess is generally L-shaped and the strip 31 includes a short leg 33 having an enlarged end portion 34 for holding the strip 31 and the other leg 35 thereof extends along the recess beyond the portion to define a sheet contacting portion. Strip is preferably made of polyurethane having a durometer of 60 on the A scale.

The fixed member 13 further includes a recess 36 extending longitudinally at the juncture of the clamping surface 14 and the projections 23. Recess 36 functions as a pocket into which any burrs may fall from a knife used for scoring the workpiece. The clamping surface 14 is spaced slightly above the projections 23 in order to minimize marring of the surface of the workpiece when it is inserted and removed.

The bending member 16 also includes a recess 37 extending longitudinally between the projections 27 and the contacting portion 31.

In use, a workpiece of sheet material is clamped against the clamping surface 14 and the bending member 16 is moved by swinging the handle H bringing the contacting portion of the bending member 16 in engagement with the sheet material. As the bending member is swung upwardly, the hinge pin 29 on the bending member 16 moves along the slots 24 and is guided in a fashion such that the contacting portion maintains substantially the same relative position of contact thereby minimizing marring of the surface of sheet material.

Figures 2, 7:
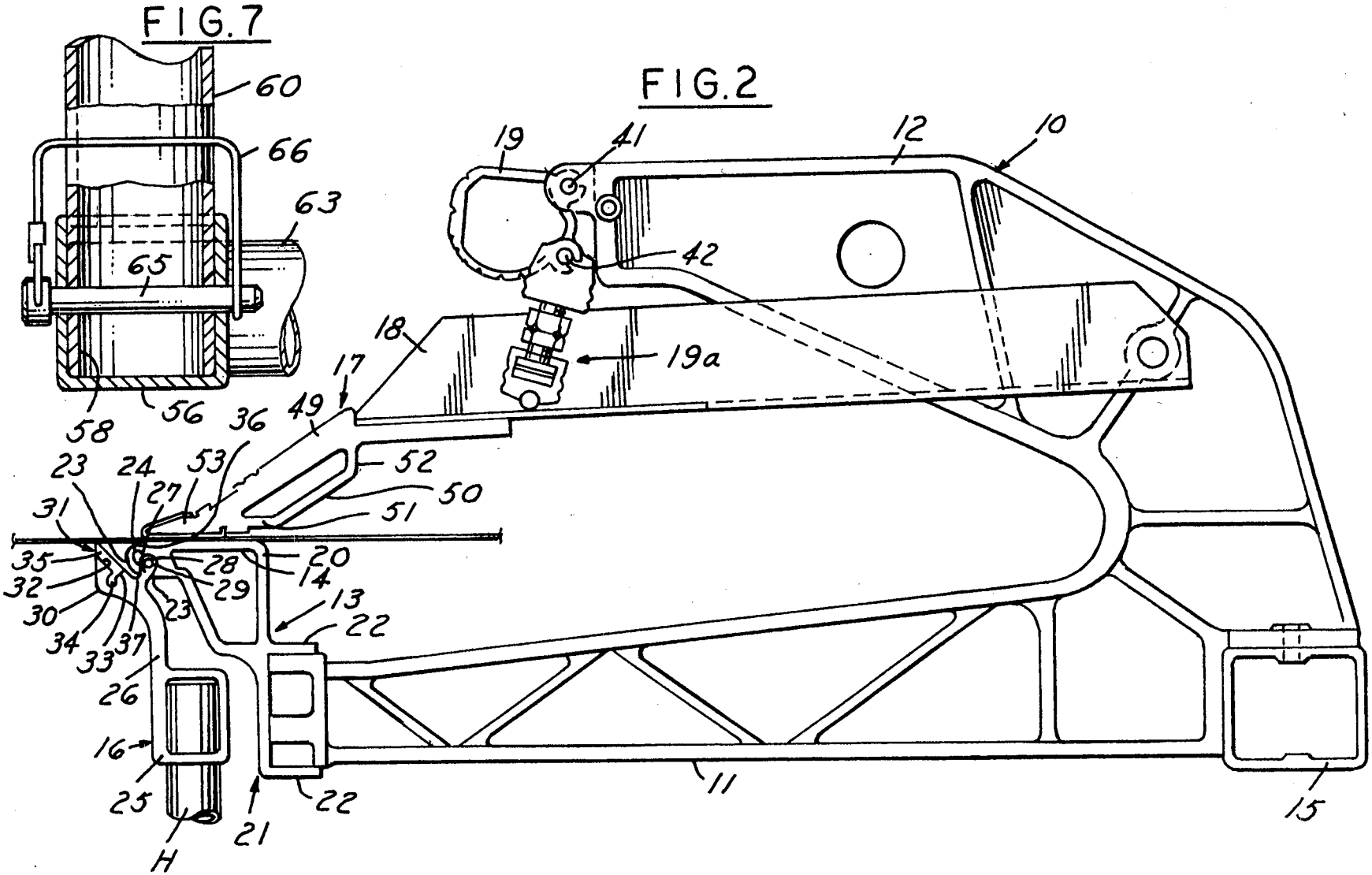
FIG. 2 is a vertical sectional view of the sheet bending brake.
FIG. 7 is a sectional view taken along the line 7—7 in FIG. 6.
Figure 4:
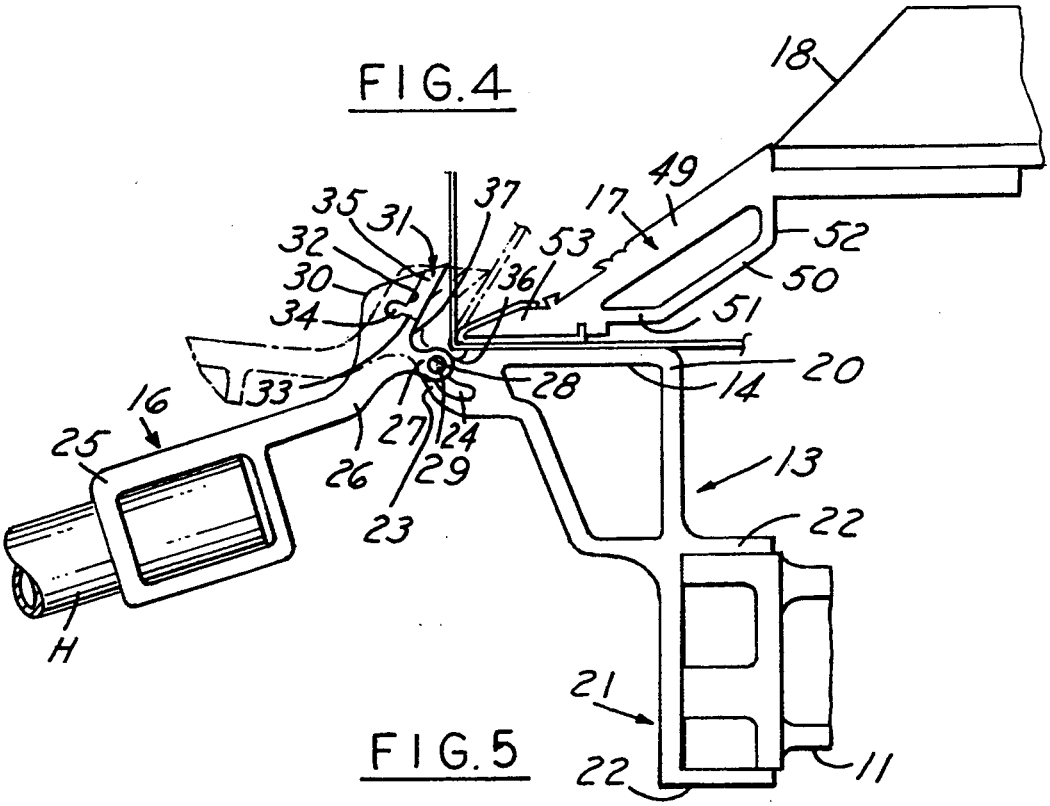
FIG. 4 is a fragmentary sectional view showing the parts in a different operative position.
Figure 5:
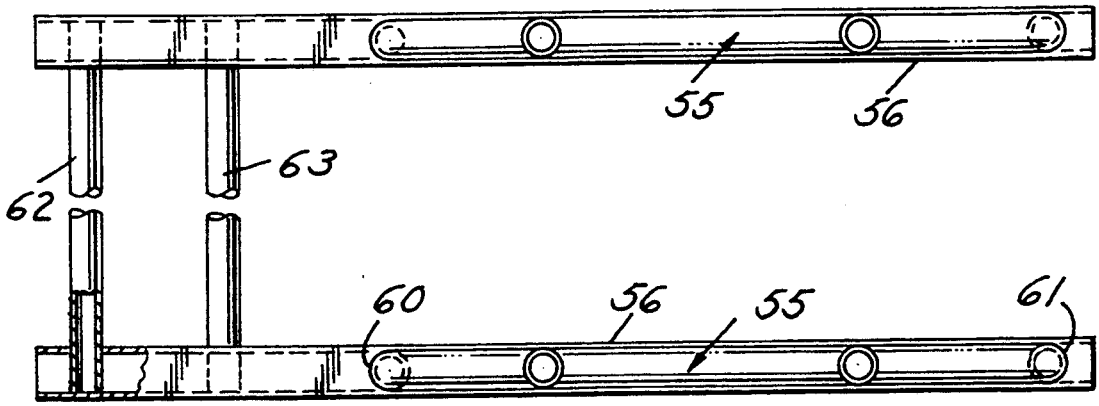
FIG. 5 is a plan view of a stabilizing assembly.
Figure 6:
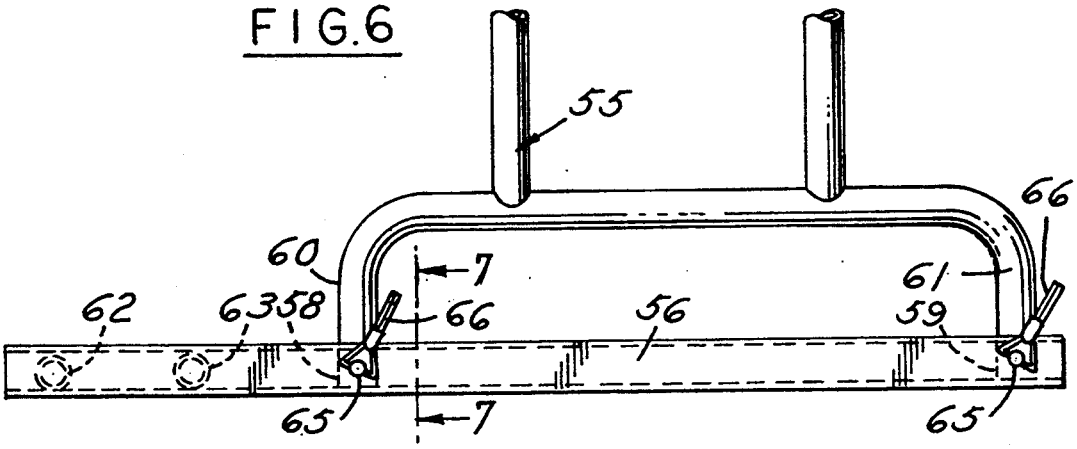
FIG. 6 is a fragmentary elevational view thereof.

As shown in FIGS. 2 and 4, the arcuate slots 24 extend generally from below the nose or bending edge of the clamping member upwardly and outwardly toward the user so that the hinge pin 16 moves along slots 24 as the workpiece is being bent until the hinge pin 29 reaches the upper end of the slots 24 (FIG. 6) after which the bending member 16 can be moved further to bend the workpiece into contact with the upper inclined surface of the clamping member 17.

The aforementioned described construction is substantially as shown in U.S. Pat. No. 4,557,132, incorporated herein by reference.

In accordance with the invention, in order to provide for bending of thicker sheet metal, certain modifications in the construction have been utilized which cooperate to produce a sheet metal bending brake which will effectively bend such sheet metal even though the sheet bending brake is not heavy and relatively portable. It has heretofore been thought to be impossible to provide a portable sheet metal bending brake that will readily bend sheet metal of increased thickness and hardness.

In accordance with the invention, the tubular handle member 19 which is connected to the members 10 by pins 41 and to the links 19 by pins 2 is provided with recesses 43, 44 defined by integral portions 45, 46, 47 and 48, respectively, that are positioned so that the recesses 43, 44 extend radially inwardly of the tubular body of the handle member and lie substantially in the circle of the tubular body of metal of the tubular hollow handle member 19 thereby improving substantially the strength of the handle member.

In addition, the anvil or clamping member 17 is formed so that it has a tubular cross section including a heavy and thicker upper wall 49 and a lighter and thinner lower wall 50 generally parallel to the wall 49 and connected thereto by integral inclined portions 51, 52. The tubular portion extends rearwardly from the clamping portion 53. It has been found that such a construction contributes substantially to the strength of the sheet bending brake and the resultant ability to bend relatively thick sheet metal.

Further, in accordance with the invention, a stabilizing assembly is added to the legs 55 which may be fixed or folded and attached to the members 13 and 15. The stabilizing assembly comprises spaced tubular transverse rails 56 which are preferably rectangular in cross section having openings 58, 59 for receiving the feet 60, 61 of the legs 55. Longitudinally extending hollow rails 62, 63 are fixed to extend lengthwise of the brake between the rails 56. The feet 60, 61 are preferably locked to the rails 56 by a pin 65 extending through the feet 60, 61 and the rails 56, 57. The pin 65 is retained by a clip 66 that is hinged to the head of the pin 65 and releasably connected to the free end of the pin 65 as shown in FIG. 7.

In use, as shown in FIG. 1, a person utilizing the sheet bending brake inserts the sheet and clamps it in position by manipulating the handle 19. The person further places one or both feet on one or both of the rails 62, 63 and simultaneously lifts the bending member 16 by means of one or more handles H. Where the length of the brake is on the order of ten feet or more and the sheet being bent is more, two persons of less stature may manipulate the brake by each person grasping a handle and placing one or both feet on the rails of the stabilizing assembly.

It has been found that by the use of such a stabilizing assembly, the force opposing the movement the bending member 16 is counteracted and the bending is facilitated.

It has been found that a sheet bending brake embodying the invention is portable and yet permits bending of the sheet material which has a thickness substantially more than that heretofore thought possible.

In tests conducted to date it has been found that the sheet material can be readily bent. The results are summarized in the following table:

TABLE

| | GAUGE | THICKNESS | ALLOY | 90 BEND | 180 BEND | TEMPER HARDNESS |
|---|---|---|---|---|---|---|
| ALUM. COIL | | .050 | 1100 | X | X | 0 thru H14 |
| | | .0453 | 3003 | X | X | 0 thru H14 |
| | | .0453 | 5005 | X | X | 0 thru H14 |
| | | .0453 | 5052 | X | X | 0 |
| ALUM. SHEET | | .032 | 6061 | X | | T4/T6 |
| | | .040 | 1100 | X | X | 0 thru H14 |
| | | .040 | 3003 | X | X | 0 thru H14 |
| | | .040 | 5005 | X | X | 0 thru H14 |
| | | .040 | 5052 | X | X | 0 thru H14 |
| | | .040 | 6061 | X | X | 0 |
| COLD ROLLED STEEL SHEET COIL COMMERCIAL QUALITY | 21 ga. | .0329 | low carbon | X | X | ASTM/A366 |

TABLE-continued

| | GAUGE | THICKNESS | ALLOY | 90 BEND | 180 BEND | TEMPER HARDNESS |
|---|---|---|---|---|---|---|
| HOT ROLLED STEEL SHEET & COIL DRAWING QUALITY | 20 ga. | .0359 | | X | X | ASTM/A620 |
| GALV. STEEL SHEET & COIL | 20 ga. | .040 | | X | | ASTM 526 |
| | 20 ga. | .040 | | | | ASTM 527 |
| | 24 ga. | .028 | | X | X | ASTM 527 |
| SOFT COPPER SHEET | 24 oz. | .0324 | soft | X | X | ASTM B-152 |
| COLD ROLLED ANNEALED COPPER ROLL | 24 oz. | .0324 | soft | X | X | ASTM B-152 |
| COLD ROLLED COPPER SHEET | 24 oz. | .0324 | ⅛ to ¼ hard | X | | ASTM B-152 |
| | 16 oz. | .0216 | ⅛ to ¼ | X | | ASTM B-152 |
| STAINLESS SHEET & COIL | 24 ga. | .0324 | type 304 & 3041 | X | | ½ HARD |
| | 24 ga. | .0324 | 316 | X | | ¼ HARD |
| BRASS SHEET & COIL | 20 ga. | .0320 | CDA260 | X | X | ½ HARD |

MATERIAL BENDING CAPABILITIES

| MATERIAL | WINDY | SUPER | WINDY HD | SUPER HD | ULTRA XL PRO T.S. | PRO HD |
|---|---|---|---|---|---|---|
| Soft Alum. | .030 | .030 | .035 | .035 | .030 | .035 |
| Hard Alum. | .022 | .022 | .025 | .025 | .022 | .025 |
| Galv. Steel | 29 ga | 29 ga | 26 ga | 26 ga | 29 ga | 26 ga |
| Copper | | | 16 oz | 16 oz | 16 oz | 16 oz |
| Vinyl | ALL STANDING VINYL SIDINGS | | | | | |

We claim:

1. A sheet bending brake comprising a base, a plurality of C-shaped members positioned on said base at longitudinally spaced points, each said C-shaped member comprising a lower arm fixed to said base and an upper arm spaced from and overlying said lower arm, a first member fixed to the lower arms of said C-shaped members and having a clamping surface, means movable toward and away from said clamping surface for locking a piece of sheet material on said clamping surface, a second member for bending a workpiece clamped on said clamping surface extending longitudinally with respect to said first member, each of said first and second members having substantially the entire length of the longitudinal edges thereof formed with longitudinally spaced intermeshing integral projections, the projections on said first member having a plurality of aligned openings comprising slots extending axially with respect to the longitudinal axis of said member, a hinge pin extending through said openings of said second member and said slots of said first member, said second member having a fixed workpiece contacting portion spaced from the projections, said workpiece contact surface being fixed relative to said hinge pin, said slots having a configuration such that as the second member is moved relative to said first member to bend a workpiece, the hinge pin is guided along said slots such that the contacting portion of said second member remains substantially in the same position relative to the workpiece during the bending operation, handle means attached to said bending member adapted to be grasped for bending a workpiece clamped on said clamping surface, said means movable toward and away from the clamping surface including a hollow clamping member pivoted to said C-shaped members and a handle member that is pivoted to said C-shaped members and to said movable means, said handle member including spaced recesses for receiving pins on said respective members, said clamping member extending longitudinally of said brake and being generally hollow, said hollow clamping member comprising spaced generally parallel walls, said walls including an upper wall having a greater thickness than said lower wall and integral portions connecting said two walls.

2. The sheet bending brake set forth in claim 1 wherein said handle member extending longitudinally of said brake and including a longitudinally extending body, said recesses of said handle member extending radially inwardly of said tubular body of the tubular handle member and lying substantially within the confines of the body of the handle member.

3. The sheet bending brake set forth in claim 2 said sheet bending brake being constructed and arranged such that when a workpiece of increased thickness is being bent, forces occur which oppose the movement of the bending member including a stabilizing assembly for counteracting such forces on said sheet bending brake comprising longitudinally spaced legs on said sheet bending brake, transversely spaced rails receiving the ends of said legs, and at least one longitudinally extending rail interconnecting said transverse rails extending longitudinally of said brake, the weight and positioning of said sheet bending brake, legs and rail being such that in the absence of said stabilizing assembly when bending thicker metal, the force opposing bending is not counteracted and the bending can not be achieved and such that the operator may place a foot on the longitudinal rail during the lifting movement of the bending member for performing the bending.

4. The sheet bending brake set forth in claim 1 including a stabilizing assembly for said sheet bending brake comprising longitudinally spaced legs on said sheet bending brake, transversely spaced rails having openings receiving the ends of said legs, and at least one longitudinally extending rail interconnecting said transverse rails extending longitudinally of said brake and such that the operator may place a foot on the longitudinal rail during the lifting movement of the bending member for performing the bending.

5. The sheet bending brake set forth in claim 4 wherein said legs comprise spaced feet and means removably connecting said feet in said openings and said longitudinal rail.

6. The sheet bending brake set forth in claim 5 including a second longitudinally extending rail extending between said transverse rails.

7. The sheet metal bending brake set forth in claim 1 including a stabilizing assembly for said sheet bending brake comprising longitudinally spaced legs on said sheet bending brake, transversely spaced rails receiving the ends of said legs, and at least one longitudinally extending rail interconnecting said transverse rails extending longitudinally of said brake, the weight and positioning of said sheet bending brake, legs and rail being such that in the absence of said stabilizing assembly when bending thicker metal, the force opposing bending is not counteracted and the bending cannot be achieved and such that the operator may place a foot on the longitudinal rail during the lifting movement of the bending member for performing the bending.

* * * * *